US006438517B1

(12) United States Patent
Yeldener

(10) Patent No.: US 6,438,517 B1
(45) Date of Patent: Aug. 20, 2002

(54) MULTI-STAGE PITCH AND MIXED VOICING ESTIMATION FOR HARMONIC SPEECH CODERS

(75) Inventor: Suat Yeldener, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/559,040

(22) Filed: Apr. 27, 2000

Related U.S. Application Data

(62) Division of application No. 09/081,410, filed on May 19, 1998.

(51) Int. Cl.[7] ..... G10L 11/06
(52) U.S. Cl. ..... 704/208
(58) Field of Search ..... 704/206, 207, 704/208, 220

(56) References Cited

U.S. PATENT DOCUMENTS

| | | | | |
|---|---|---|---|---|
| 5,195,166 A | * | 3/1993 | Hardwick et al. | 704/200 |
| 5,216,747 A | * | 6/1993 | Hardwick et al. | 704/208 |
| 5,581,656 A | * | 12/1996 | Hardwick et al. | 704/258 |
| 5,701,390 A | * | 12/1997 | Griffin et al. | 704/206 |
| 5,754,974 A | * | 5/1998 | Griffin et al. | 704/206 |

OTHER PUBLICATIONS

Griffin, D.W., Lim, J.S., "Multiband Excitation Vocoder", IEEE Trans. on Acoustics, Speech and Signal Processing, 1980, vol. 36, No. 8, pp. 1223–1234.*

McAulay, R.J., Quatieri, T.F., "Pitch Estimation and Voicing Detection Based on a Sinusoidal Speeck Model", 1990, Proc. of ICASSP–90, vol. 2, pp. 249–252.*

Yeldener, S., Kondoz, A.M., Evans, B.G., "A High Quality Speech Coding Algorithm Suitable for Future INMARSAT Systems", European Signal Proc. Conf. (EUSIPCO–94), Edinburgh, Sep. 1994, p. 407–410.*

* cited by examiner

*Primary Examiner*—Tālivaldis Ivars Šmits
*Assistant Examiner*—Angela Armstrong
(74) *Attorney, Agent, or Firm*—Robert L. Troike; Frederick J. Telecky, Jr.

(57) ABSTRACT

A "multi-stage" method of estimating pitch in a speech encoder (FIG. 2). In a first stage of the method, a set of candidate pitch values is selected, such as by using a cost function that operates on said speech signal (steps 21–23). In a second stage of the method, a best candidate is selected. Specifically, in the second stage, pitch values calculated from previous speech segments are used to calculate an average pitch value (step 25). Then, depending on whether the average pitch value is short or long, one of two different analysis-by-synthesis (ABS) processes is then repeated for each candidate, such that for each iteration, a synthesized signal is derived from that pitch candidate and compared to a reference signal to provide an error value. A time domain ABS process is used if the average pitch is short (step 27), whereas a frequency domain ABS process is used if the average pitch is long (step 28). After the ABS process provides an error for each pitch candidate, the pitch candidate having the smallest error is deemed to be the best candidate.

4 Claims, 4 Drawing Sheets

MULTI-STAGE PITCH AND MIXED VOICING ESTIMATION FOR HARMONIC SPEECH CODERS

This application is a divisional of application Ser. No. 09/081,410 filed May 19, 1998, which claims priority under 35 §119(e)(1) of provisional application No. 60/047,182, filed May 20, 1997.

TECHNICAL FIELD OF THE INVENTION

The present invention relates generally to the field of speech coding, and more particularly to encoding methods for estimating pitch and voicing parameters.

BACKGROUND OF THE INVENTION

Various methods have been developed for digital encoding of speech signals. The encoding enables the speech signal to be stored or transmitted and subsequently decoded, thereby reproducing the original speech signal.

Model-based speech encoding permits the speech signal to be compressed, which reduces the number of bits required to represent the speech signal, thereby reducing data transmission rates. The lower data rates are possible because of the redundancy of speech and by mathematically simulating the human speech-generating system. The vocal tract is simulated by a number of "pipes" of differing diameter, and the excitation is represented by a pulse stream at the vocal chord rate for voiced sound or a random noise source for the unvoiced parts of speech. Reflection coefficients at junctions of the pipes are represented by coefficients obtained from linear prediction coding (LPC) analysis of the speech waveform.

The vocal chord rate, which as stated above, is used to formulate speech models, is related to the periodicity of voiced speed, often referred to as pitch. In an analog time domain plot of a speech signal, the time between the largest magnitude positive or negative peaks during voiced segments is the pitch period. Although speech signals are not perfectly periodic, and in fact, are quasi-periodic or non-stationary signals, an estimated pitch frequency and its reciprocal, the pitch period, attempt to represent the speech signal as truly as possible.

For speech encoding, an estimation of pitch is made, using any one of a number of pitch estimation algorithms. However, none of the existing estimation algorithms have been entirely successfully in providing robust performance over a variety of input speech conditions.

Another parameter of the speech model is a voicing parameter, which indicates which portions of the speech signal are voiced and which are unvoiced. Voicing information may be used during encoding to determine other parameters. Voicing information is also used during decoding, to switch between different synthesis processes for voiced or unvoiced speech. Typically, coding systems operate on frames of the speech signal, where each frame is a segment of the signal and all frames have the same length. One approach to representing voicing information is to provide a binary voiced/unvoiced parameter for each entire frame. Another approach is to divide each frame into frequency bands and to provide a binary parameter for each band. However, neither approach provides a satisfactory model.

SUMMARY OF THE INVENTION

One aspect of the invention is a multi-stage method of estimating the pitch of a speech signal that is to be encoded.

In a first stage of the method, a set of candidate pitch values is selected, such as by applying a cost function to the speech signal. In a second stage of the method, a best candidate is selected. Specifically, in the second stage, pitch values calculated for previous speech segments are used to calculate an average pitch value. Then, depending on whether the average pitch value is short or long, one of two different analysis-by-synthesis (ABS) processes is performed. The ABS process is repeated for each candidate, such that for each iteration, a synthesized speech signal is derived from that pitch candidate and compared to the input speech signal. A time domain ABS process is performed if the average pitch is short, whereas a frequency domain ABS process is performed if the average pitch is long. Both ABS processes provide an error value corresponding to each pitch candidate. The pitch candidate having the smallest error is deemed to be the best candidate.

An advantage of the pitch estimation method is that it is robust, and its ability to perform well is independent of the peculiarities of the input speech signal. In other words, the method overcomes the problem encountered by existing pitch estimation methods, of dealing with a variety of input speech conditions.

Another aspect of the invention is a mixed voicing estimation method for determining the voiced and unvoiced characteristics of an input speech signal that is to be encoded. The method assumes that a pitch for the input speech signal has previously been estimated. The pitch is used to determine the harmonic frequencies of the speech signal. A probability function is used to assign a probability value to each harmonic frequency, with the probability value being the probability that the speech at that frequency is voiced. For transmission efficiency, a cut-off frequency can be calculated. Below the cut-off frequency, the speech signal is assumed to be voiced so that no probability value is required. The voicing estimator provides an improved method of modeling voicing information. It permits a probability function to be efficiently used to differentiate between voiced and unvoiced portions of mixed speech signals.

DETAILED DESCRIPTION OF THE INVENTION

Figure 1A:
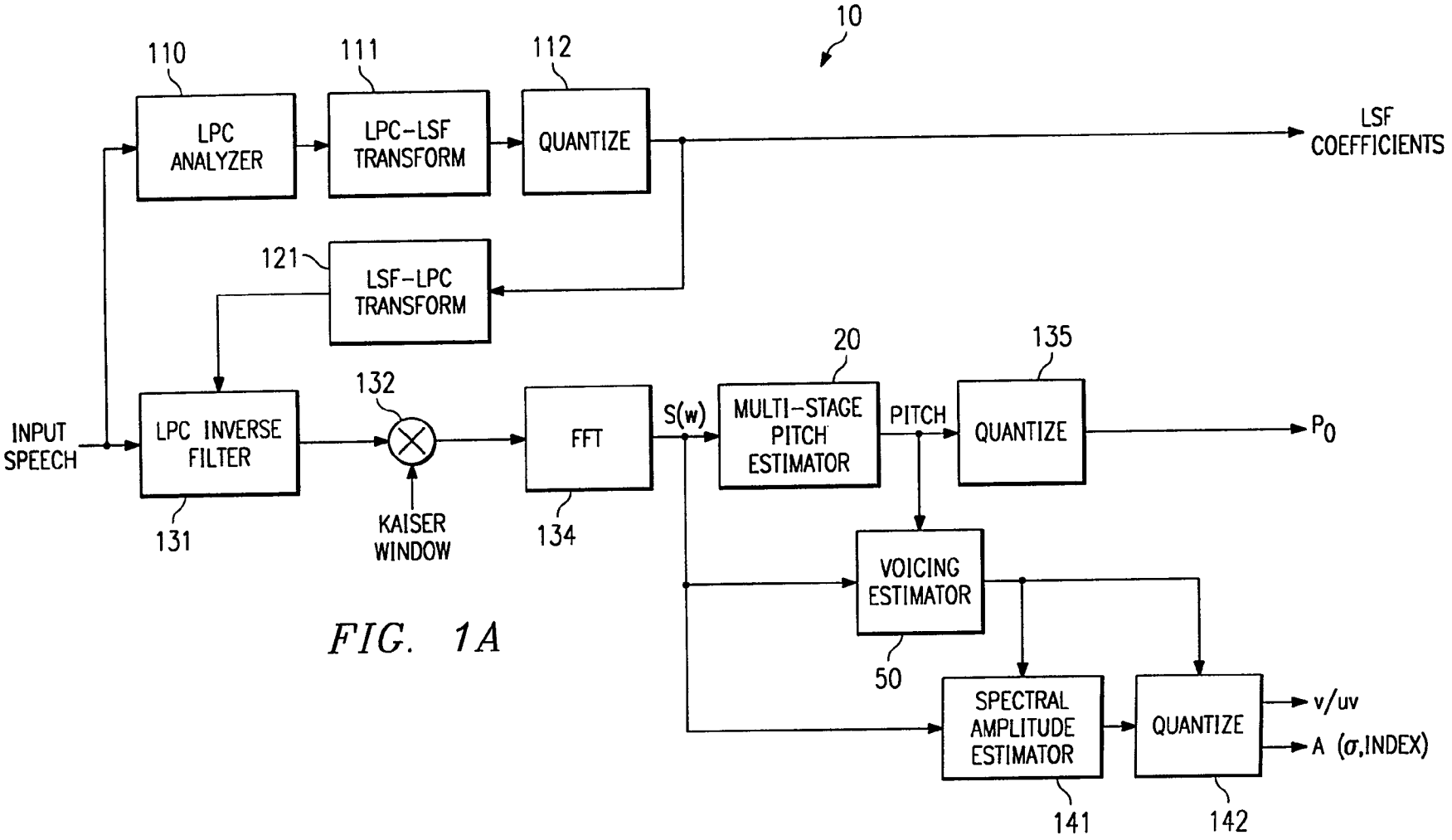
FIGS. 1A and 1B are block diagrams of an encoder and decoder, respectively, that use the pitch estimator and/or voicing estimator in accordance with the invention.
Figure 1B:
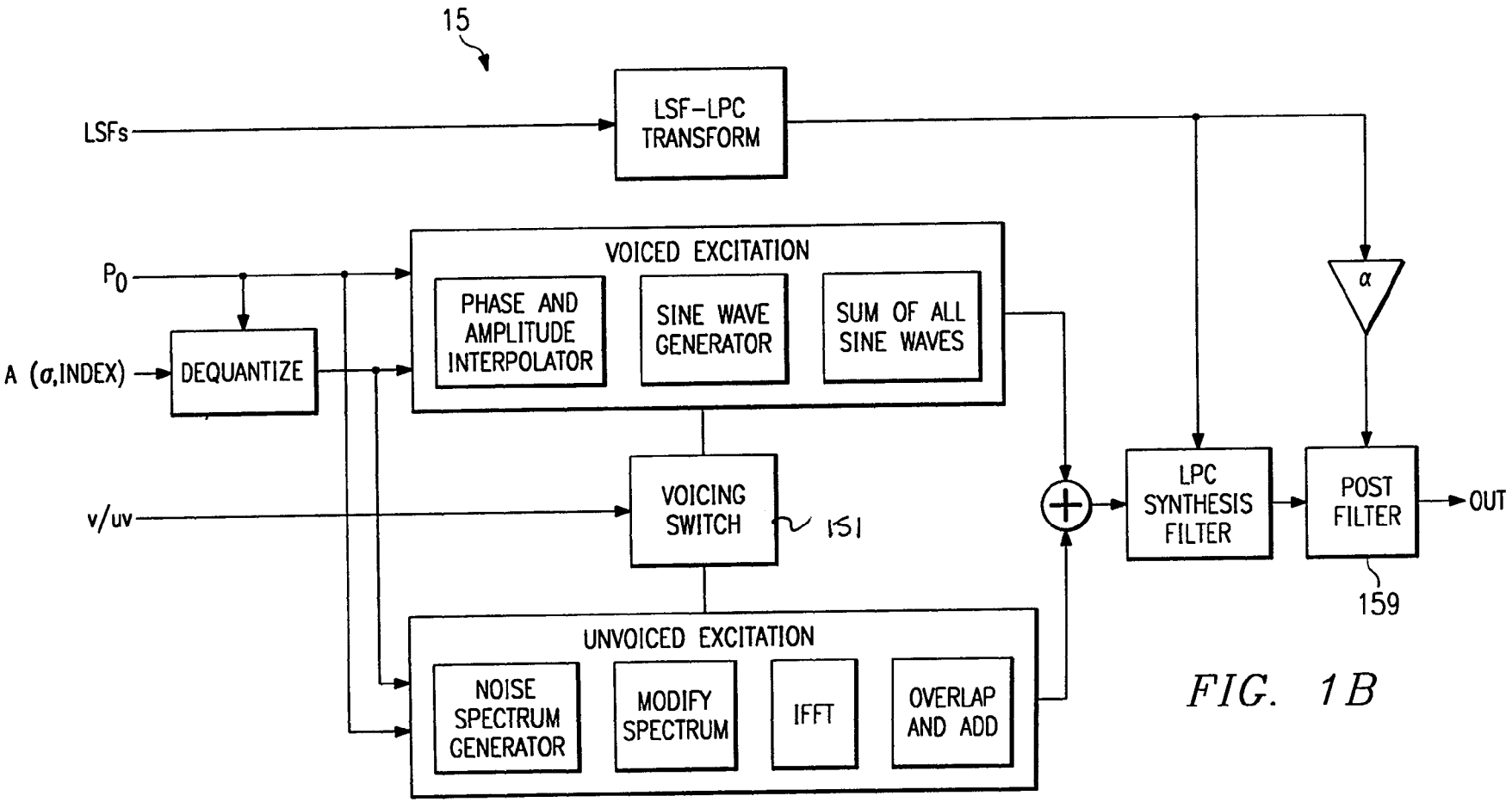

FIGS. 1A and 1B are block diagrams of a speech encoder 10 and decoder 15, respectively. Together, encoder 10 and decoder 20 comprise a model-based speech coding system. As stated in the Background, the model is based on the idea that speech can be represented by exciting a time-varying digital filter at the pitch rate for voiced speech and randomly for unvoiced speech. The excitation signal is specified by the pitch, the spectral amplitudes of the excitation spectrum, and voicing information as a function of frequency.

The invention described herein is primarily directed to the pitch estimator 20 and the voicing estimator 50 of FIG. 1A. The voicing parameters, v/uv, are in a form that is interpreted by the voicing switch 151 of FIG. 1B. An overview of the complete operation of the coding system is set out below for a more complete understanding of the system aspects of the invention.

In the specific embodiment of FIGS. 1A and 1B, encoder 10 and decoder 15 comprise what is known as a Mixed Sinusoidal Excited Linear Predictive Speech Coder (MSE-LPC), which is a low bit rate (4 kb/s or less), system. However, it should be understood that encoder 10 and decoder 15 are but one type of encoder and decoder with which the invention may be used. In general, they may be used in any harmonic coding system, that is, a coding system in which voiced components are represented with harmonics of an estimated pitch.

Furthermore, the pitch estimator 20 and voicing estimator 50 could be used together in the same system as illustrated in FIG. 1A. However, they are independently useful in that an encoder 10 might have one or the other and not necessarily both.

Encoder 10 and decoder 20 are essentially comprised of processes that may be executed on digital processing and data storage devices. A typical device for performing the tasks of encoder 10 or decoder 20 is a digital signal processor, such as the TMS320C30, manufactured by Texas Instruments Incorporated. Except for pitch estimator 20 and voicing estimator 50, the various components of encoder 10 can be implemented with known devices and techniques.

Overview of Speech Coding System

In general, encoder 10 processes an input speech signal by computing a set of parameters that represent a model of the speech source signal and that can be stored or transmitted for subsequent decoding. Thus, given a segment of a speech signal, the encoder 10 must determine the filter coefficients, the proper excitation function (whether voiced or unvoiced), the pitch period, and harmonic amplitudes. The filter coefficients are determined by means of linear prediction coding (LPC) analysis. At the decoder 15, an adaptive filter is excited with a periodic impulse train having a period equal to the desired pitch period. Unvoiced signals are generated by exciting the filter model with the output of a random noise generator. The encoder 10 and decoder is operate on speech signal segments of a fixed length, known as frames.

Referring to the specific components of FIG. 1A, sampled output from a speech source (the input speech signal) is delivered to an LPC (linear predictive coding) analyzer 110. LPC analyzer 110 analyzes each frame and determines appropriate LPC coefficients. These coefficients may be calculated using known LPC techniques. A LPC-LSF transformer 111 converts the LPC coefficients to line spectral frequency (LSF) coefficients. The LSF coefficients are delivered to quantizer 112, which converts the input values into output values having some desired fidelity criterion. The output of quantizer 112 is a set of quantized LSF coefficients, which are one type of output parameter provided by encoder 10.

For pitch, voicing, and harmonic amplitude estimation, the quantized LSF coefficients are delivered to LSF-LPC transform unit 121, which converts the LSF coefficients to LPC coefficients. These coefficients are filtered by an LPC inverse filter 131, and processed through a Kaiser window 132 and FFT (fast Fourier transform) unit 134, thereby providing an LPC excitation signal, S(w). As explained below, this S(w) signal is used by the multi-stage pitch estimator 20, the voicing estimator 50, and the harmonic amplitude estimator 141, to provide.additional output parameters.

The operation of pitch estimator 20 is explained below in connection with FIGS. 2–4. The output of pitch estimator 20, an estimated pitch value, is delivered to quantizer 135, whose output represents the pitch parameter, $P_0$. As explained below, the estimated pitch value is also delivered to the voicing estimator 50.

The operation of voicing estimator 50 is explained below in connection with FIGS. 5 and 6. Its output is quantized by quantizer 142 thereby providing the output parameters, u/uv. The voicing output is also used by the spectral amplitude estimator 141, whose output is quantized by quantizer 142 to provide the harmonic amplitude parameters, A.

Pitch Estimation

Figure 2:
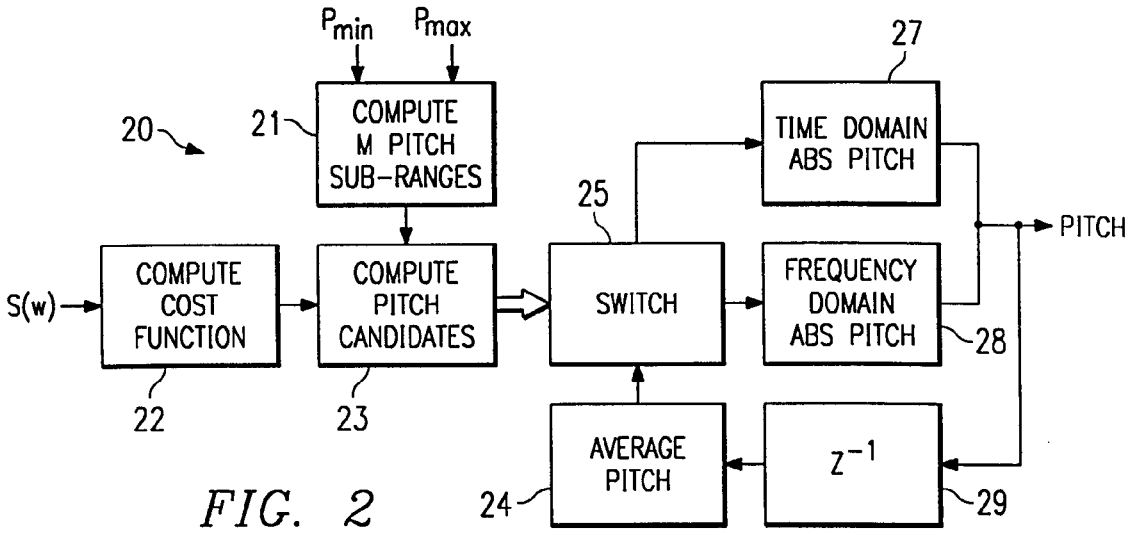
FIG. 2 is a block diagram of the process performed by the pitch estimator of FIG. 1A.

FIG. 2 is a block diagram of the process performed by the pitch estimator 20 of FIG. 1. The pitch estimator 20 is "multi-stage" in the sense that a first stage determines a number of candidate pitch values and a second stage selects a best one of these candidates. The first stage uses a cost function, whereas the second stage uses either of two analysis-by-synthesis estimations.

In step 21, a pitch range, $P_{min}$ to $P_{max}$, is divided into a number, M, of pitch sub-ranges. There can be various rules for this division into sub-ranges. In the example of this description, the pitch range is divided into sub-ranges in a logarithmic domain having smaller sub-ranges for short pitch periods and larger sub-ranges for longer pitch periods. The logarithmic sub-range size, Δ, is computed as:

$$\Delta = \frac{[\log_{10}(P_{\max}) - \log_{10}(P_{\min})]}{M} = \frac{[\log_{10}(P_{\max})/P_{\min})]}{M},$$

where $P_{max}$ and $P_{min}$ are the maximum and minimum pitch values in the input samples and M is the number of sub-ranges. The $P_{max}$ and $P_{min}$ values may be constant for all input speech. For example, suitable values might be $P_{max}$=128 samples and $P_{min}$=16 samples, for an input signal sampled at an appropriate sampling rate.

For each sub-range, a starting and ending pitch value, $\Gamma_s(i)$ and $\Gamma_e(i)$, is computed as follows:

$$\Gamma_s(i)=10^{[\log 10(pmin)+(i-1)\Delta]}$$

$$\Gamma_e(i)=10^{[\log 10(pmin)+i\Delta]}$$

where $1 \leqq i \leqq M$.

In step 22, pitch cost function is applied to all pitch values, P, within the range of pitch values from $P_{min}$ to $P_{max}$. Because the final pitch value is not computed directly from the cost function, a computational efficiency can be optimized over accuracy if desired. In the embodiment of this description (consistent with FIG. 1A), a frequency domain cost function operates on values of S(w). This frequency domain cost function, σ(P), is expressed as follows:

$$\sigma(P) = \sum_{k=1}^{L_p} \left| S_\omega\left(\frac{2\pi k}{P}\right) \right| \left\{ \max_{\omega_l \in d\left(\frac{2\pi k}{P}\right)} \left[ A_l D\left(\omega_l - \frac{2\pi k}{P}\right) \right] - \frac{1}{2} \left| S_\omega\left(\frac{2\pi k}{P}\right) \right| \right\},$$

where $P_{min} \leqq P < P_{max}$ and the values of $|S\omega(2\,\Pi k/P)|$ are the harmonic magnitudes. Also, $(2\,\Pi(k-0.5))/P \leqq (d(2\,\Pi k))/$ $P<(2\ \Pi(k+0.5))/P$ . The values $A_1$ and $w_1$ are the peak magnitudes and frequencies, respectively, and D(x)=sinc(x). The summation is over the number of harmonics, $L_p$, corresponding to the current P value.

It should be understood that a time domain pitch cost function could also be used, with calculations modified accordingly. Various frequency domain and time domain pitch cost function algorithms have been developed and could be used as alternatives to the one set out above.

In step 23, the pitch cost function is maximized for each sub-range to obtain M initial pitch candidate values. As a result of step 23, there is one pitch candidate for each sub-range. Thus, the number of pitch candidates is also M.

As an example of steps 22 and 23, the pitch range might be 16 to 128 with ten sub-ranges. The cost function would be computed for each pitch value of the entire pitch range, that is, for pitch values 16, 17, 18 . . . . , 128. Within a first sub-range of pitches, say 16 to 20, the pitch having the maximum cost function value would be selected as the pitch candidate for that sub-range. This selection would be repeated for each of the M sub-ranges, resulting in M pitch candidates.

In step 24, an average pitch value is computed, $P_{avg}(n)$, for each nth frame, using pitch values from previous frames. The average pitch calculation may be expressed as follows:

$$P_{avg}(n) = \sum_{k=1}^{K} \alpha(k) P(n-k),$$

where the $\alpha(k)$ values are weighting constants, P(n−k) is the pitch corresponding to the (n=31 k)th frame, and K is the number of previous frames used for the computation of the average pitch period. Step 28 represents the delay whereby the pitch estimation for frame value is used in the average pitch calculation for the next frame.

Typically, the weighting scheme is weighted in favor of the most recent frame. As an example, three previous frames might be used, such that K=3, with weighing constants of 0.5 for the most recent frame, 0.3 for the second previous frame, and 0.2 for the third previous frame.

For initializing the average pitch calculations during the first several frames of a speech signal, a predetermined pitch value within the pitch range may be used. Also, in theory, the "average" pitch period could be a single input pitch period from only one previous frame.

A switching step, step 25, uses the average pitch value to switch between two different pitch estimation processes. The first process is a time domain analysis-by-synthesis (TD-ABS) process, whereas the second process is a frequency domain analysis-by-synthesis FD-ABS) process. As explained below, the TD-ABS process is used when the average pitch is short, whereas the FD-ABS process is used when the average pitch is long.

Both the TD-ABS estimator 27 and the FD-ABS estimator 28 perform analysis-by-synthesis (ABS) pitch estimations. The ABS method is based on the use of a trial pitch value to generate a synthesized signal which is compared to the input speech signal. The resulting error is indicative of the accuracy of the trial pitch. As implemented in the present invention, a reference signal is first obtained. Then, for each candidate pitch, a harmonic frequency generator for the harmonics of that pitch is used to construct the synthesized signal corresponding to that pitch. The two signals are then compared.

Figure 3:
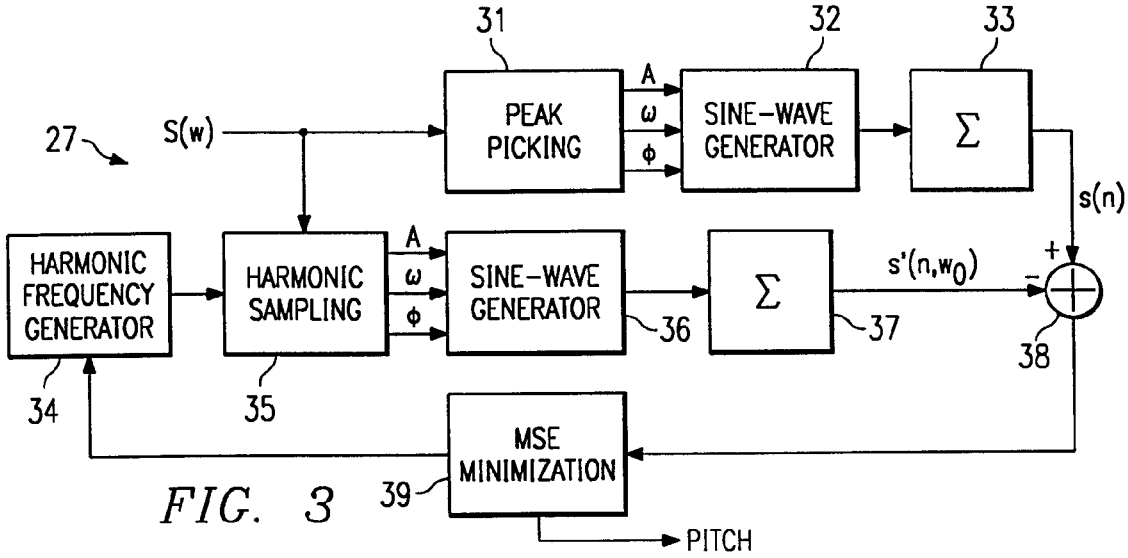
FIG. 3 illustrates the process performed by the time domain ABS process of FIG. 2.

FIG. 3 illustrates the process performed by the TD-ABS processor 27, of FIG. 2. In step 31, a peak picking function is applied to obtain the magnitudes of the peaks of the excitation signal, S(w). In step 32, a sine wave corresponding to each peak is generated. Each peak is assigned a peak amplitude, frequency, and phase, which are A, ω, and ϕ, respectively. In step 33, the sine waves are added to form a time domain reference speech signal, s(n).

Steps 34–38 are repeated for each pitch candidate. In step 34, harmonic frequencies corresponding to the current pitch candidate are generated. In step 35, the harmonic frequencies are used to sample the excitation signal, S(w). The sampled harmonics each have an associated harmonic amplitude, frequency, and phase, noted as A, ω, and ϕ, respectively. In step 36, a sine wave is generated for each harmonic. The sine waves are added in step 37 to form a synthesized speech signal corresponding to the current pitch candidate. In step 38, the reference signal and the synthesized signal are compared to obtain a mean squared error (MSE) value.

In step 39, the MSE values of each pitch candidate are used to select the best pitch candidate, i.e., the candidate whose error is smallest.

Figure 4:
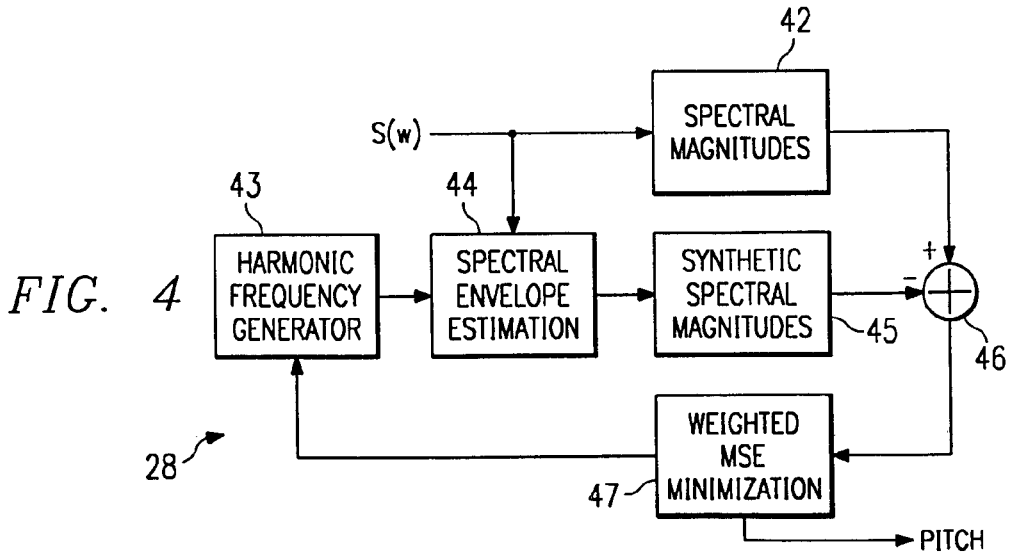
FIG. 4 illustrates the process performed by the frequency domain ABS process of FIG. 2.

FIG. 4 illustrates the process performed by the FD-ABS processor 28, of FIG. 2. In step 42, spectral magnitudes of the input signal, S(w), are obtained as a reference signal, |s(w)|.

Steps 43–46 are repeated for each candidate pitch value. In step 43, harmonic frequencies are generated, using the current candidate pitch value. In step 44, a spectral envelope is estimated, using the original excitation signal, s(w). Sampling at the harmonic frequencies may be used to accomplish step 44, which provides the harmonic amplitudes from which the spectral envelope is estimated. In step 45, the spectral envelope is used to construct synthesized spectral magnitudes, |S'(w)|. In step 46, the reference magnitudes and the synthesized magnitudes are compared to obtain a mean squared error (MSE). The MSE may be weighted, such as in favor of low frequency components.

In step 47, the minimum MSE value is determined. The corresponding pitch candidate is the candidate with the best pitch value.

The use of switching between time and frequency domain pitch estimation is based on the idea that the ability to match a synthesized harmonics signal to a reference signal varies depending on whether the pitch is short or long. For short pitch periods, there are just a few harmonics and it is easier to match time domain speech waveforms. On the other hand, when the pitch period is long, it is easier to match speech spectra.

Referring again to FIGS. 1A and 2, the output of the pitch estimator 20 is an estimated pitch value. After being quantized, this value is one of the parameters provided by encoder 10. The estimated pitch value is also delivered to voicing estimator 50 for use during determination of the voicing parameters.

Voicing Estimation

Referring to FIG. 1A, another aspect of the invention is a voicing estimator 50 that is based on a mixed voicing representation. As explained below, the voice estimator 50 calculates a cut-off frequency of the harmonic frequencies. Below the cut-off frequency, the harmonics are assumed to be voiced. Above the cut-off frequency, the harmonics are assumed to be mixed, that is, having both voiced and unvoiced energies for each harmonic.

Figure 5:
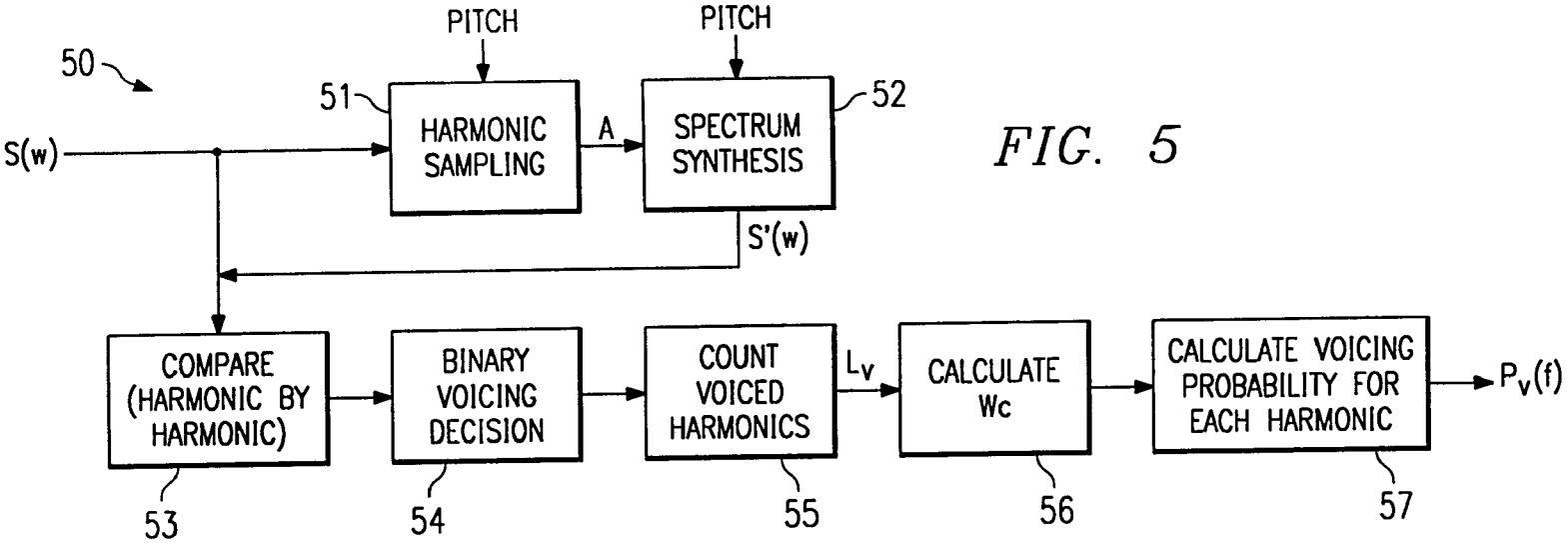
FIG. 5 illustrates the process performed by the voicing estimator of FIG. 1A.

FIG. 5 illustrates the process performed by voicing estimator 50. In steps 51 and 52, a synthetic speech spectrum is synthesized, by using the estimated pitch from pitch estimator 20 to sample at the harmonic frequencies associated- .with that pitch. In step 53, for each harmonic frequency, the original and synthesized spectra, S(w) and S'(w), are compared.

In step 54, the results of the comparisons are used to determine a binary voicing decision for each harmonic. This can be accomplished by using the comparison step, step 53, to generate an error signal. The error signal may be compared to a threshold for that harmonic that determines whether the harmonic is voiced or unvoiced.

The cut-off frequency, $W_c$, is determined by the ratio between the voiced harmonics and the total number of harmonics in a 4 kilohertz speech bandwidth. The calculation of $W_c$, in hertz, is expressed mathematically as follows:

$$W_c 4000(L_v/L),$$

where $L_v$ and L are the number of voiced harmonics and the total number of harmonics, respectively.

Thus, in step 55, the number of voiced harmonics, $L_v$, is counted. In step 56, the cut-off frequency, $W_c$, is calculated according to the above equation.

In step 57, for each harmonic, a voicing probability as a function of frequency, $P_v(f)$, is calculated. This probability defines the ratio between voiced and unvoiced harmonic energies. For each harmonic, once the probability of voiced energy, $P_v$, is known, the probability of unvoiced energy, $P_{uv}$, is computed as:

$$P_{uv}(f)=1.0-P_v(f)$$

Figure 6:
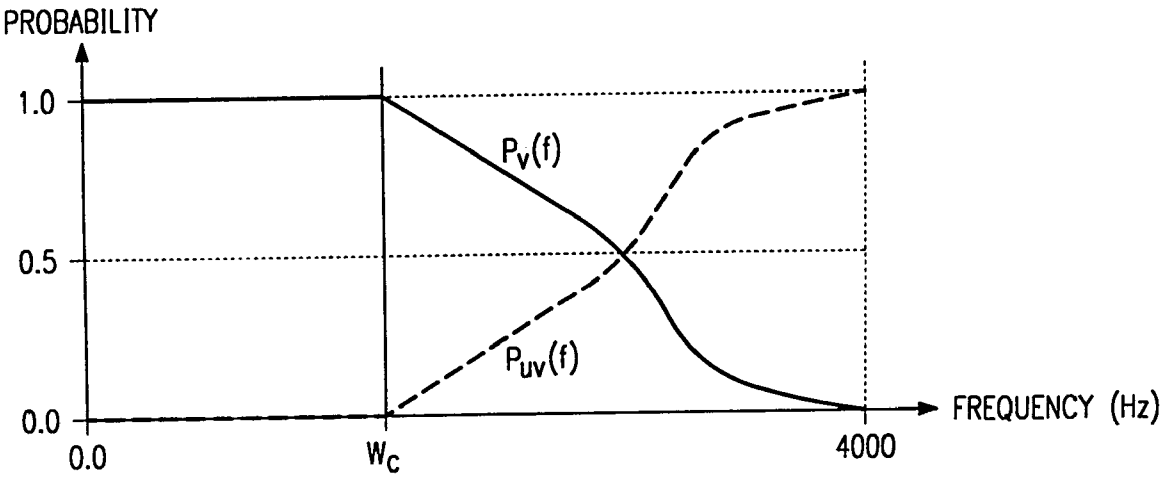
FIG. 6 illustrates the relationship between voiced is and unvoiced probability and the cut-off frequency calculated by the process of FIG. 5.

FIG. 6 illustrates the probabilities for voiced and unvoiced speech as a function of frequency. As illustrated, below the cut-off frequency, all speech is assumed to be voiced. Above the cut-off frequency, the speech has a mixed voiced/unvoiced probability representation. The transmitted u/uv parameter can be in the form of either $W_c$ or $P_v(f)$, because of their fixed relationship illustrated in FIG. 6.

The embodiment of FIG. 5, which incorporates the use of a cut-off frequency, is designed for transmission efficiency. Below, the cut-off frequency, the voiced probability values for the harmonics are a constant value (1.0). Only those harmonics above the cut-off frequency need have an associated probability. In a more general application, the entire speech signal (all harmonics) could be modeled as mixed voiced and unvoiced. This approach would eliminate the use of a cut-off frequency. The probability function would be modified so that there is a probability value between 0 and 1 for each harmonic frequency.

Referring again to FIGS. 1A and 1B, the total voiced and unvoiced energies for each harmonic are transmitted in the form of the A parameters. At the decoder 15, a voicing switch uses the voicing probability to separate the voiced and unvoiced energies for each harmonic. They are then synthesized, using separate voiced and unvoiced synthesizers.

Other Embodiments

Although the present invention has been described with several embodiments, various changes and modifications may be suggested to one skilled in the art. It is intended that the present invention encompass such changes and modifications as fall within the scope of the appended claims.

What is claimed is:

1. A method of modeling the voiced or unvoiced characteristics of a segment of an input signal, comprising the steps of:

receiving a pitch value associated with said input speech signal;

comparing a synthesized speech signal to said input speech signal on a harmonic by harmonic basis;

for each harmonic, determining whether said harmonic is voiced or unvoiced;

counting the number of said harmonics that are voiced;

calculating a cut-off frequency of said input speech signal, using the ratio of the results of said counting step and the total number of said harmonics, such that said cut-off frequency represents a frequency below which said speech signal is assumed to be voiced and above which said speech signal is comprised of both voiced and unvoiced speech; and generating a synthesized representation of said speech signal using said pitch value such that for each harmonic that falls below the cut-off frequency the harmonics are assumed to be voiced and for each harmonic above the cut-off frequency the harmonics are assumed to be mixed using both voiced and unvoiced energies for each harmonic.

2. The method of claim 1, wherein said step of generating a synthesized representation is performed by sampling said input speech at harmonics of said pitch.

3. The method of claim 1, wherein said step of determining whether said harmonic is voiced or unvoiced is performed by comparing an error value provided by said comparing step to a threshold associated with said harmonic.

4. The method of claim 1, wherein said step of calculating a cut-off frequency is performed by multiplying said ratio times an encoding frequency range.

* * * * *